US009746166B2

(12) United States Patent
Habchi

(10) Patent No.: US 9,746,166 B2
(45) Date of Patent: Aug. 29, 2017

(54) LIGHT BULB

(71) Applicant: Philippe Georges Habchi, Long Beach, CA (US)

(72) Inventor: Philippe Georges Habchi, Long Beach, CA (US)

( * ) Notice: Subject to any disclaimer, the term of this patent is extended or adjusted under 35 U.S.C. 154(b) by 63 days.

(21) Appl. No.: 14/931,380

(22) Filed: Nov. 3, 2015

(65) Prior Publication Data

US 2017/0122537 A1 May 4, 2017

(51) Int. Cl.

| | |
|---|---|
| ***F21S 4/00*** | (2016.01) |
| ***F21V 23/00*** | (2015.01) |
| ***F21K 9/278*** | (2016.01) |
| ***F21K 9/275*** | (2016.01) |
| *F21V 29/83* | (2015.01) |
| *F21K 9/90* | (2016.01) |
| *F21V 29/74* | (2015.01) |
| *F21Y 115/10* | (2016.01) |

(52) U.S. Cl.

CPC ..... *F21V 23/009* (2013.01); *F21K 9/275* (2016.08); *F21K 9/278* (2016.08); *F21K 9/90* (2013.01); *F21V 29/74* (2015.01); *F21V 29/83* (2015.01); *F21Y 2115/10* (2016.08)

(58) Field of Classification Search

CPC ..... F21V 23/009; F21V 29/83; F21K 9/90
USPC ..... 362/221, 217.01, 222, 224, 217.13
See application file for complete search history.

(56) References Cited

U.S. PATENT DOCUMENTS

| | | | |
|---|---|---|---|
| 8,319,437 | B2 | 11/2012 | Carlin et al. |
| 8,403,541 | B1 | 3/2013 | Rashidi |
| 8,836,231 | B2 | 9/2014 | Bradford |
| 2014/0211477 | A1 | 7/2014 | Anderson |

FOREIGN PATENT DOCUMENTS

| | | |
|---|---|---|
| CA | 2604364 | 3/2008 |

OTHER PUBLICATIONS

Tim Whitaker, Zhaga, and Joseph Frederic, UL; Replacement Light Sources and Zhaga Specifications; Online Article; Posted Oct. 21, 2014; http://www.zhagastandard.org/features/120/replaceable-light-sources-and-zhaga-specifications.

*Primary Examiner* — Vip Patel
(74) *Attorney, Agent, or Firm* — Mu P.C.

(57) ABSTRACT

A modular light bulb and a method of assembling it are disclosed. The modular light bulb comprises a light source unit, an optical unit enclosing the light source unit, a driver unit configured to drive the light source unit, a base unit engageable with a light bulb socket, and a chassis unit. The driver unit is removably accommodated within the chassis unit and has a releasable electrical connection to the base unit and a releasable electrical connection to the light source unit passing through the base unit. The base unit is releasably fastened onto the chassis unit, the light source unit is releasably fastened onto the chassis unit, and the optical unit is releasably fastened onto the chassis unit.

12 Claims, 10 Drawing Sheets

800
810
826

808
818
826

800
802
826
824
804
820
824

808
805
803
814
812
826
824
820
826

LIGHT BULB

TECHNICAL FIELD

The present disclosure generally relates to light bulbs. In particular, a modular light bulb and a method of assembling the modular light bulb are presented.

BACKGROUND

Light bulbs have been used for decades as a means to provide illumination and come in various forms. Typically, today's light bulbs are manufactured in a permanent manner by assembling the bulb components with the use of adhesive and soldering. For example, adhesive material or thermal bonding is used to fasten an optical lens onto a bulb chassis and to fasten a base to each end of the bulb chassis. Also, wires are used to electrically connect the base to a light source driver as well as the light source driver to a light source within the bulb, wherein the ends of the wires are soldered at respective soldering points of these components. Typically, four soldering points for electrically connecting the bases to the driver and four soldering points for electrically connecting the driver to the light source are required. Due to such permanent assembly, when a bulb breaks, the entire assembly needs to be thrown away. This may entail a waste of material because the components of the light bulb may have differing life spans. Components which may still be in good working condition are thus trashed unnecessarily.

SUMMARY

Accordingly, there is a need for a light bulb that avoids waste of material when the bulb breaks.

According to a first aspect, a modular light bulb is provided. The modular light bulb comprises a light source unit, an optical unit enclosing the light source unit, a driver unit configured to drive the light source unit, a base unit on each side engageable with a light bulb socket, and a chassis unit. The driver unit is removably accommodated within the chassis unit and has a releasable electrical connection to the base units. The light source unit is releasably fastened onto the chassis unit, and the optical unit is releasably fastened over the light source unit onto the chassis unit. The base units are releasably fastened onto each end of the chassis unit and have a releasable electrical connection to the light source unit.

The releasable electrical connection between the driver unit and the base unit may comprise at least one plug and socket connection. In one variant, the releasable electrical connection between the driver unit and the base unit may comprise a plug and socket connection formed between the driver unit and the base unit.

The releasable electrical connection between the base unit and the light source unit may comprise at least one plug and socket connection. In one variant, the releasable electrical connection between the base unit and the light source unit may comprise a plug and socket connection formed between the base unit and the light source unit.

In each such plug and socket connection, a plug may be formed of two conductors which extend from one unit into a socket formed at the other unit. In one such variant, a plug for a plug and socket connection may be formed of two conductors extending from the light source unit. In this case, the plug may extend into a socket formed at the base unit. In another variant, a socket may be formed at the light source unit, wherein the socket receives a plug formed of two conductors extending from the base unit. It will be understood that such variants may apply to the plug and socket connection between the driver unit.

In another such variant, a plug for a plug and socket connection may be formed of two conductors extending from the driver unit. In this case, the plug may extend into a socket formed at the base unit. In another variant, a socket may be formed at the driver unit, wherein the socket receives a plug formed of two conductors extending from the base unit.

A base unit may comprise a first portion and a second portion electrically isolated from one another. The releasable electrical connection between the driver unit and the base unit may comprise a first conductor extending from the driver unit and contacting the first portion of the base unit and a second conductor extending from the driver unit and contacting the second portion of the base unit. In one variant, the first conductor may be received in a retaining hole formed at the first portion of the base unit. Similarly, the releasable electrical connection between the light source unit and the base unit may comprise a first conductor extending from the light source unit and contacting the first portion of the base unit and a second conductor extending from the light source unit and contacting the second portion of the base unit.

The base unit may be fastened to the chassis unit using a form-lock between the second portion of the base unit and the lower chassis unit.

Further, the driver unit may be enclosed within the chassis unit. The base unit is for electrically connecting the driver unit to the light source unit.

For heat dissipation purposes, the chassis unit may include at least one aperture for heat dissipation. Also, the chassis unit may have heatsink characteristics for heat dissipation on its outside. Moreover, when the optical unit is fastened to the chassis unit using a form-lock, at least the chassis unit and the optics unit may comprise at least one groove in a region of the form-lock so that the at least one groove forms an aperture for heat dissipation.

A releasable locking mechanism may be used for releasably fastening the base units onto the chassis unit, the light source unit onto the chassis unit, and the optical unit onto the chassis unit.

According to a second aspect, a method of assembling a modular light bulb is provided. The method comprises inserting a driver unit into a chassis unit, the base unit and the chassis unit being configured to be releasably fastened to one another, fastening a light source unit onto the chassis unit, the light source unit and the chassis unit being configured to be releasably fastened to one another, the driver unit being configured to drive the light source unit through a base unit, and fastening an optical unit onto the chassis unit, the optical unit and the chassis unit being configured to be releasably fastened to one another, so that the optical unit encloses the light source unit, fastening a base unit onto each end of the chassis unit, wherein fastening the base unit onto the ends of the chassis unit comprises establishing a releasable electrical connection between the base unit and the driver unit, and between the base unit and the light source unit, the base unit being engageable with a light bulb socket.

According to a third aspect, a light source unit for use in a modular light bulb is provided. The light source unit is configured to be releasably fastened to a chassis unit of the modular light bulb and comprises one of a plug and a socket for establishing a releasable electrical connection to a driver unit of the modular light bulb, either through a based unit or directly, for driving the light source unit using a plug and socket connection. The plug may comprise two conductors extending from the light source unit. The light source unit may be configured to be releasably fastened to the chassis unit using a releasable locking mechanism.

According to a fourth aspect, a driver unit for use in a modular light bulb is provided. The driver unit is configured to be removably accommodated within a chassis unit of the modular light bulb and configured to drive a light source unit of the modular light bulb, wherein the driver unit comprises one of a plug and a socket for establishing a releasable electrical connection to the light source unit using a plug and socket connection. The plug may comprise two conductors extending from the driver unit. The driver unit may further comprise a first conductor extending from the driver unit for contacting a first portion of a base unit of the modular light bulb and a second conductor extending from the driver unit for contacting a second portion of the base unit of the modular light bulb. The driver unit may be enclosed in an insert of the modular light bulb. The insert may include at least one aperture for heat dissipation.

According to a fifth aspect, base units for use in a modular light bulb is provided. The base units are configured to be releasably fastened to a chassis unit of the modular light bulb and being engageable with a light bulb socket, wherein each base unit comprises a first portion and a second portion electrically isolated from one another. The base unit may be configured to be releasably fastened to the chassis unit using a releasable locking mechanism.

According to a sixth aspect, a chassis unit for use in a modular light bulb is provided. The chassis unit is configured to removably accommodate therein a driver unit of the modular light bulb, wherein the chassis unit is configured to releasably fasten thereon a plurality of base units of the modular light bulb, wherein the chassis unit is configured to releasably fasten thereon a light source unit of the modular light bulb, and wherein the chassis unit is configured to releasably fasten thereon an optical unit of the modular light bulb. The chassis unit may be fastened to a base unit using a form-lock. The chassis unit may further have heatsink characteristics for heat dissipation on its outside. The optical unit may be fastened to the chassis unit using a form-lock, wherein the chassis unit may comprise at least one groove in a region of the form-lock so that the at least one groove forms an aperture for heat dissipation. The chassis unit may be configured to be releasably fastened to a plurality of base units using a releasable locking mechanism, the chassis unit may be configured to be releasably fastened to the light source unit using a releasable locking mechanism, and the chassis unit may be configured to be releasably fastened to the optical unit using a releasable locking mechanism.

BRIEF DESCRIPTION OF THE DRAWINGS

An exemplary embodiment of a modular light bulb according to the present disclosure is described herein below with reference to the accompanying drawings, in which.

DETAILED DESCRIPTION

In the following description, for purposes of explanation and not limitation, specific details are set forth in order to provide a thorough understanding of the present disclosure. It will be apparent to one skilled in the art that the present disclosure may be practiced in other embodiments that depart from these specific details.

Figure 1:
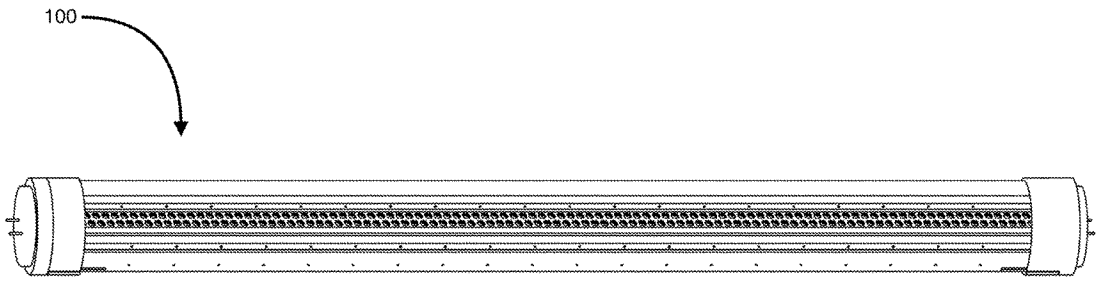
FIG. 1 illustrates the modular light bulb in a perspective view.

FIG. 1 illustrates an exemplary embodiment of a modular light bulb 100. The modular light bulb 100 is illustrated as an T-Series bulb. The modular light bulb 100 may be an indoor or an outdoor light bulb.

Light bulbs may generally come in a range of shapes, sizes and bases with names that may consist of one or more letters followed by one or more numbers that may vary in different countries. The letters represent the type of bulb which is known as the "series" and the numbers represent the diameter either in inch or in millimeters depending on the shape and the country. It will be readily apparent to one of ordinary skill in the art that the principles of the present disclosure can be practiced using other series, shapes and types such as, for example, indoor and outdoor T-Series also known as Tubular bulbs also known as lamps that are Linear-shaped, Circular-shaped, U-shaped, or Similarly shaped that use miniature, medium, standard, single pin, bi-pin, quad-pin or similar bases also known as end caps that use Light Emitting Diode (LED), Light Emitting Plasma (LEP), Light Emitting Filament (LEF) or similar light bulbs that may operate under the principles of the present disclosure.

Figure 2:
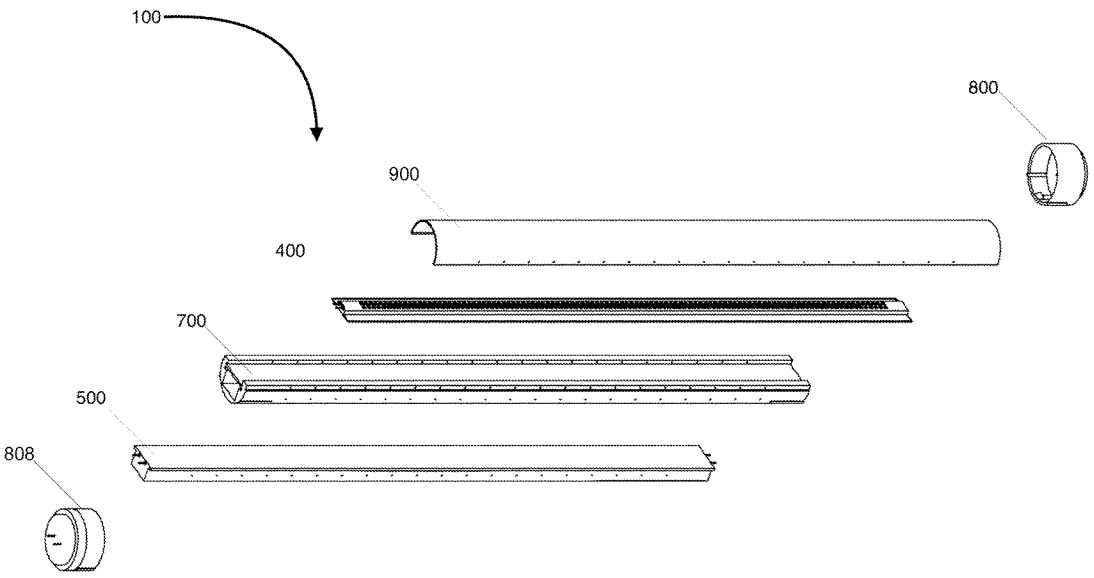
FIG. 2 illustrates the modular light bulb in a disassembled state.

FIGS. 1 and 2 illustrate the modular light bulb 100 in an assembled and a disassembled state, respectively. As may be seen in these figures, the modular light bulb 100 comprises several independent components which can be assembled and disassembled in an adhesive-less, solder-less and tool-less manner, as will be explained in more detail below. The components include a light source unit 400, an (insert enclosed) driver unit 500 configured to drive the light source unit 400, a chassis unit 700, a base unit 800 engageable with a light bulb socket, and an optical unit 900 for enclosing the light source unit 400. Each of the components will be described in more detail below with reference to FIGS. 3A to 9.

Figure 3A:
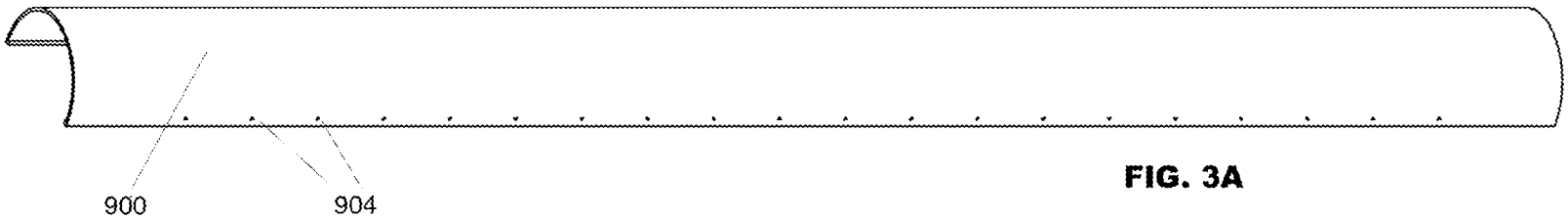
FIG. 3A illustrates the optical unit in a perspective view.
Figure 3B:
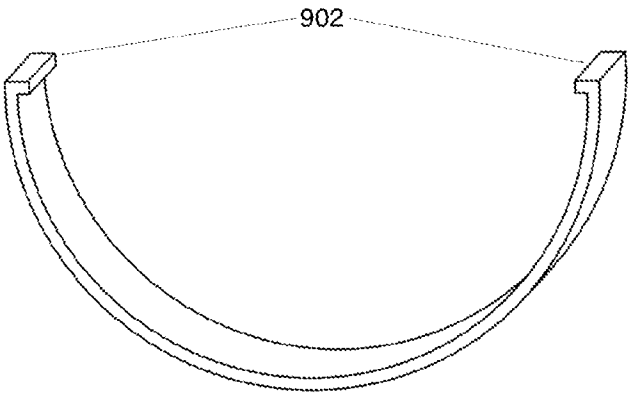
FIG. 3B illustrates the optical unit in a cross-sectional view.

FIGS. 3A and 3B illustrate the optical unit 900 of the modular light bulb 100 in different perspective views. The optical unit 900 is an independent component which may be manufactured and offered separately. The optical unit 900 is a translucent optical lens for the purpose of protecting the light source unit 400. The optical unit 900 may come in various finishing types, including different colors and frosted finishing, for example. The optical unit 900 has a plurality of ventilation holes 904 distributed along its length.

For releasably fastening the optical unit 900 onto the chassis unit 700 in the exemplary embodiment described herein, the optical unit 900 comprises at its bottom a lip portion 902 which mates with the groove portion 730 of the chassis unit 700 and is engageable therewith. When a spreading force is applied to the opening between the lip portions 902, the lips may be positioned within groove portions 730 and retained by a resilient force. In an alternative embodiment, the lip portions 902 may be slid into the groove portions 730 as the optical unit is slid over the chassis unit 700.

Figure 4A:
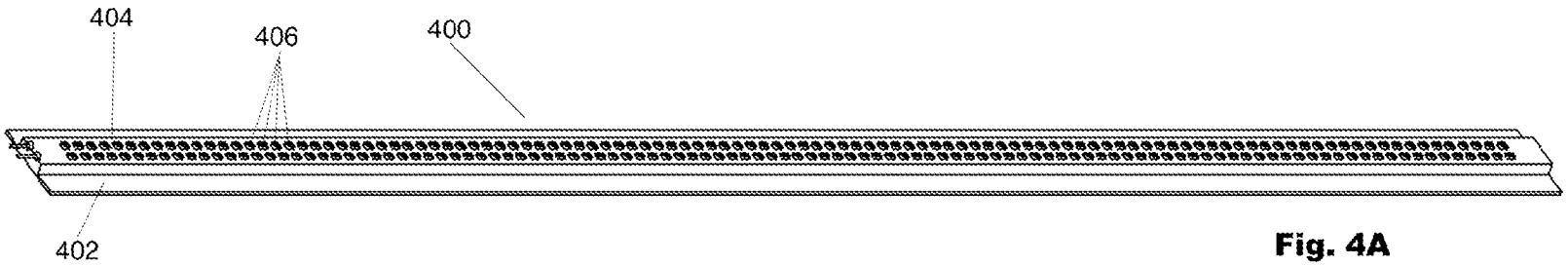
FIG. 4A illustrates the light source unit of the modular light bulb.
Figure 4B:
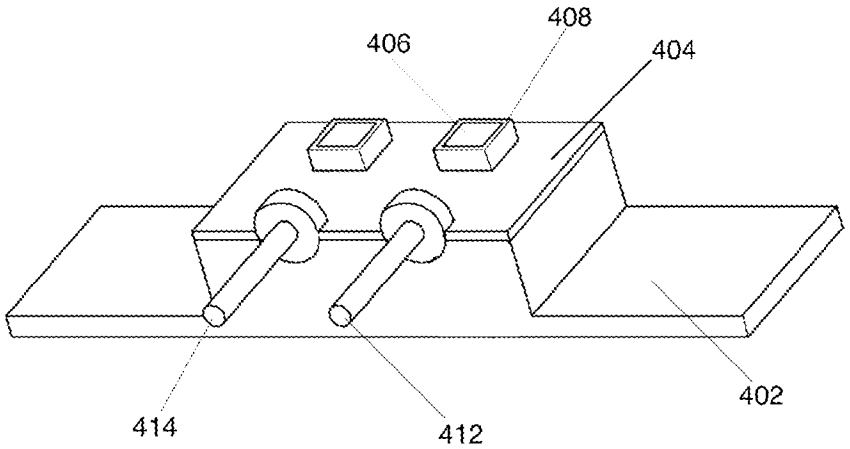
FIG. 4B illustrates the plug of a light source unit of the modular light bulb.

FIGS. 4A and 4B illustrate the light source unit 400 of the modular light bulb 100 in different perspective views. The light source unit 400 is an independent component which may be manufactured and offered separately. The light source unit 400 is configured to emit light and uses Light Emitting Diode (LED) technology in the exemplary embodiment described herein. It will be readily apparent to one of ordinary skill in the art, however, that the principles of the present disclosure can be practiced using other light-emitting technologies, such as, for example, Light Emitting Plasma (LEP), Light Emitting Filament (LEF) or similar light emitting technologies. The employed light emitting technology may generally comprise integrated optical components to shape its radiation pattern, reflective material, conductors, glue and other material required to implement its light emitting characteristic.

In the exemplary embodiment described herein, the light source unit 400 comprises a base 402 on which a plurality of light source strips 404 are mounted. Each light source strip 404 comprises a plurality of LEDs 406, wherein each LED 406 is held in place using a Surface Mounted Device (SMD) 408. Each light source strip 404 comprises a semi-flexible Printed Circuit Board (PCB) that connects a plurality of SMDs 408 together.

For releasably fastening the light source unit 400 onto the chassis unit 700 in the exemplary embodiment described herein, the base 402 of the light source unit 400 has precise measurements to fit into a slot 718 (shown in FIGS. 5A and 5B) formed in the chassis unit to form an interference fit therewith when plugged into the slot 718. The light source unit 400 further comprises two conductors 412 and 414 extending from the light source unit 400. The conductors 412 and 414 may be used to establish electrical connectivity to the driver unit 500. In the exemplary embodiment shown, the conductors 412 and 414 extend from the base 402 into an opposite direction of the light source strips 404.

Figure 5A:
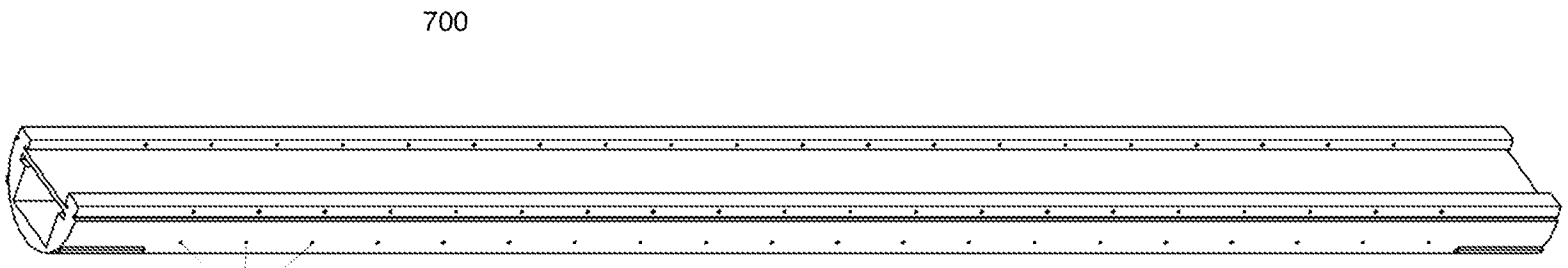
FIG. 5A illustrates the chassis unit of the modular light bulb in a perspective view.
Figure 5B:
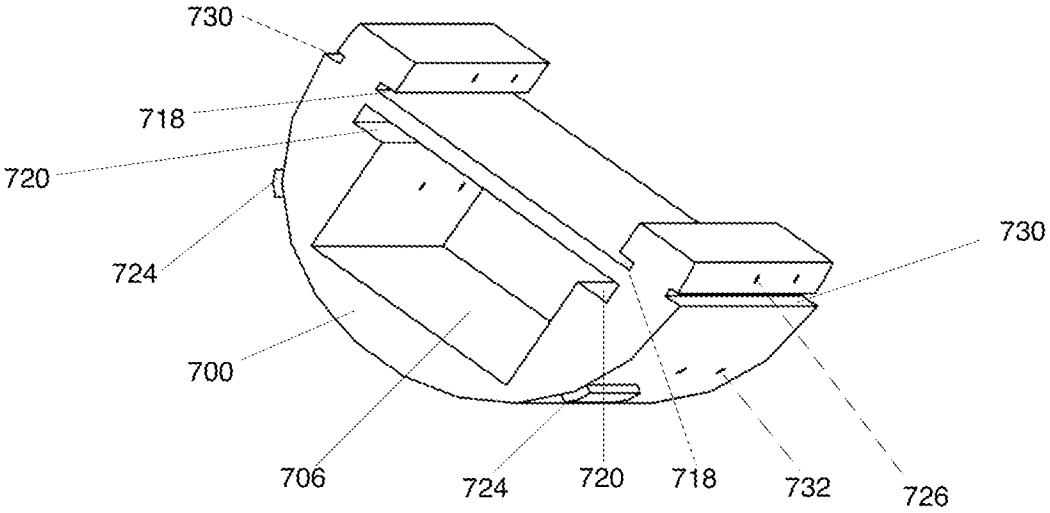
FIG. 5B illustrates the chassis unit of the modular light bulb in a cross-sectional view.

FIGS. 5A and 5B illustrate the chassis unit 700 of the modular light bulb 100. The chassis unit 700 is an independent component which may be manufactured and offered separately. The chassis unit 700 forms the central component of the modular light bulb 100 to which other components of the modular light bulb 100 can be releasably fastened. Also, the chassis unit 700 provides a compartment 706 for removably accommodating the (insert enclosed) driver unit 500 therein. The compartment may have shoulder grooves 720 to accommodate the insert's shoulders 520. The chassis unit may have lower ventilation apertures 732 and upper ventilation apertures 726 to facilitate cooling of the driver 500 and light source 400, respectively.

For releasably fastening the light source 400 onto the chassis unit 700 in the exemplary embodiment described herein, the chassis unit 700 comprises a slot 718 for receiving the base 402 of the light receiving unit 400 which have mating shapes to form an interference fit once the base 402 is plugged into the slot 718. The interference fit is achieved by a slightly deviated size of the base 402 and the slot 718 so that, when one part is pressed onto the other, the occupation of space results in a slight elastic deformation that creates a friction force allowing the base 402 and the slot 718 to fasten and unfasten.

Figure 6A:
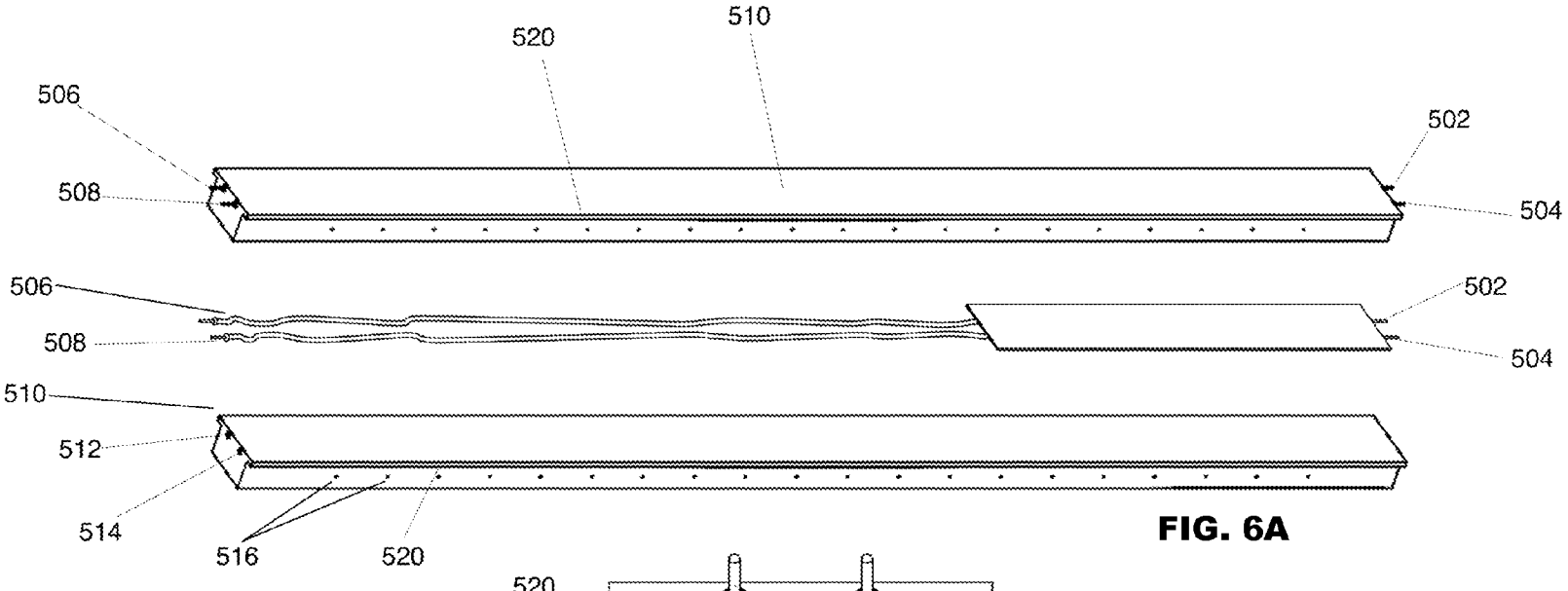
FIG. 6A illustrates the driver unit of the modular light bulb in an exploded view.
Figure 6B:
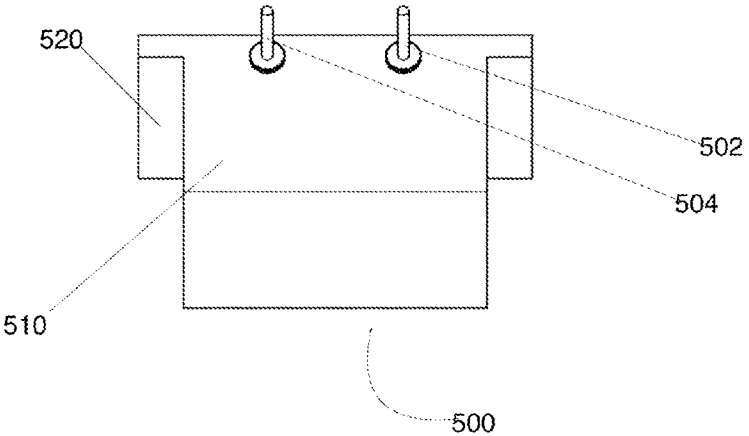
FIG. 6B illustrates the plug of the driver unit of the modular light bulb in a detail view.
Figures 7A, 7B, 7C, 7D:
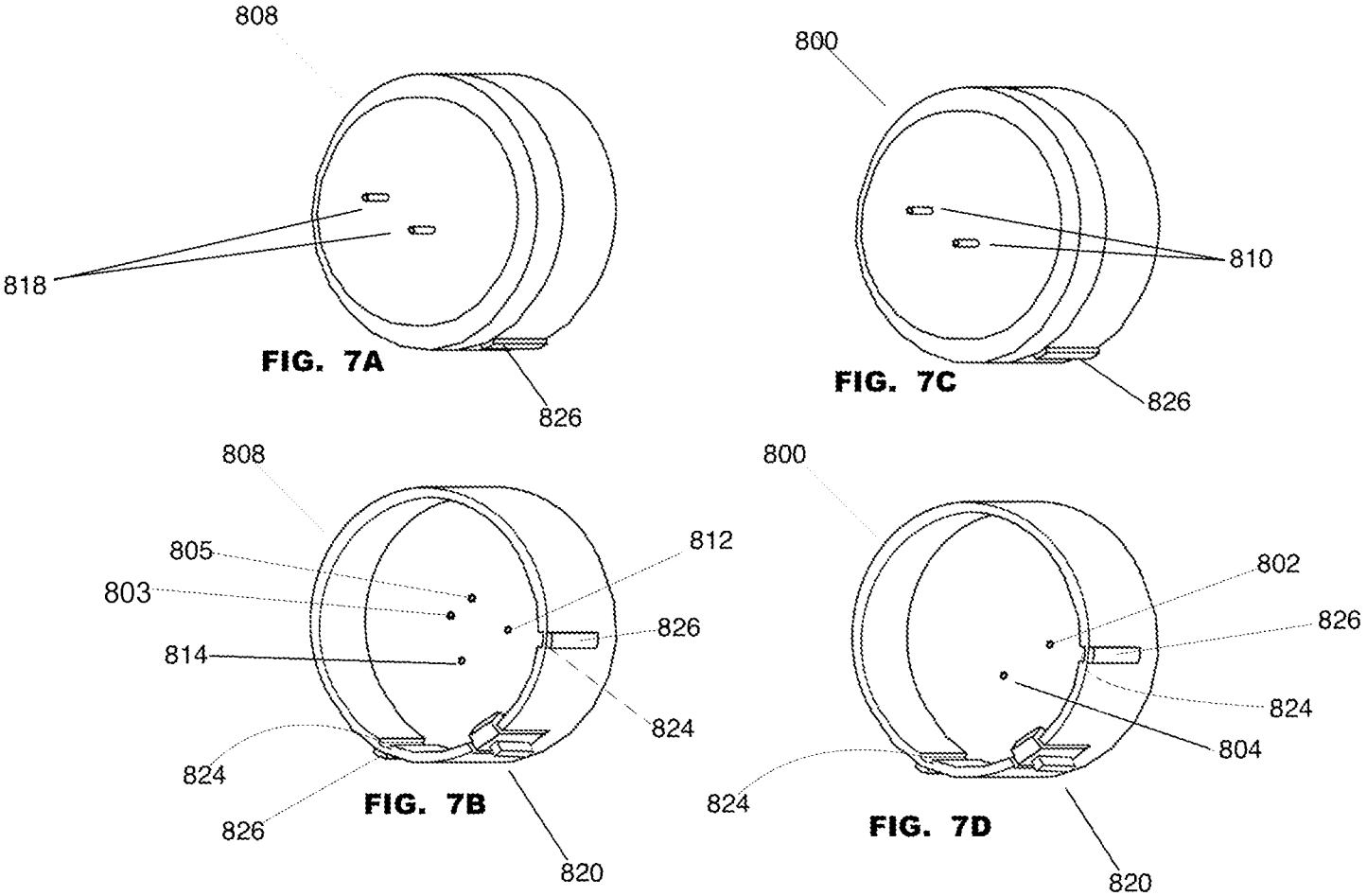
FIG. 7A illustrates the base unit of a first end in a front perspective view.
FIG. 7B illustrates the base unit of a first end in a rear perspective view.
FIG. 7C illustrates the base unit of a second end in a front perspective view.
FIG. 7D illustrates the base unit of a second end in a rear perspective view.

FIGS. 6A and 6B illustrate the driver unit 500 of the modular light bulb 100. The driver unit 500 is an independent component which may be manufactured and offered separately. The driver unit 500 has a power management function and may be responsible for at least one of routing, regulating and converting current received from a light bulb socket via the base unit 808 (shown in FIGS. 7A-7D) to the light source unit 400. For example, the driver unit 500 may receive current from a light bulb socket via the base unit 800, 808 at AC, for example at 110V or 220V or another voltage depending on the country, and may convert and route the current to the light source unit 400 at DC, for example at 12V. In another example, the driver unit 500 may transfer current at DC (e.g., received at DC from an external driver) to the light source unit 400 at DC without converting and regulating the current. As illustrated in FIG. 5, the driver unit 500 may have a flat shape and may come in the form of a Printed Circuit Board (PCB).

The driver unit 500 comprises two conductors 502 and 504 extending therefrom at a side facing the first base unit 800. The conductors 502 and 504 may be used to establish electrical connectivity to the base unit 800. The driver unit 500 further comprises two conductors 506 and 508 extending at a side facing the second base unit 808. The conductors 506 and 508 may be used to establish electrical connectivity to the base unit 808.

For removably accommodating the driver unit 500 within the chassis unit 700 in the exemplary embodiment described herein, the driver unit 500 is enclosed in an insert 510 which fits into the chassis unit 700. The driver unit 500 may have precise measurements that fit into an inner structure of the insert 510 for holding the driver unit 500 in place. The insert 510, in turn, may have precise measurements that fit into the chassis unit 700, for example, using an edge to edge fit. In an embodiment, the insert 510 has protruding shoulders 520 that engage with shoulder grooves 720. Thus, once the insert 510 is inserted into the chassis unit 700, the insert 510 is automatically fastened into position.

The insert 510 provides a protective compartment for the driver unit 500, facilitates the overall modularity of the light bulb 100 and simplifies assembly of the driver unit 500 into the chassis unit 700. As such, it is conceivable to provide the driver unit 500 and the insert 510 in a pre-assembled manner as an "insert enclosed driver unit" which can be manufactured, pre-assembled and offered as an independent component. Such "insert enclosed driver unit" is depicted in FIG. 5A.

In the exemplary embodiment described herein, the driver unit 500 is electrically connectable to the light source unit 400 via the base unit 808 (described with reference to FIGS. 7A-7D below). The first base unit 800 may be plugged onto the conductors 502 and 504 of the driver unit 500 after inserting the driver unit 500 into the insert 510 which faces the light source unit 400. Two holes 512 and 514 are provided at each side of the insert 510 which align with the first portion and second portion 802 and 804 of the base unit 800, and align with connectors 812 and 814 of base unit 808. For heat dissipation purposes, the insert 510 may include apertures 516 to allow heat generated by the driver unit 500 to dissipate out of the insert 510.

It will be understood that enclosing the driver unit 500 by an insert 510 that fits into the chassis 700 is just one example of accommodating the driver unit 500 within the chassis unit 700. It will be readily apparent to one of ordinary skill in the art that other ways of accommodating the driver unit 500 within the chassis unit 700 are conceivable.

With reference to FIGS. 5B and 7A-7D, for releasably fastening the base unit 800 onto the chassis unit 700 in the exemplary embodiment described herein, the chassis unit 700 comprises alignment tabs 724 which are engageable with corresponding mating grooves 824 of the base unit 800 so that the base unit 800 is fastened over the ends of the chassis unit 700 in a form-locking manner when the tabs 724 are engaged within grooves 824. Groove 824 may have a corresponding protrusion 826 on the external surface of base unit 800 and 808.

For releasably fastening the optical unit 900 onto the chassis unit 700 in the exemplary embodiment described herein, the chassis unit 700 comprises a groove 730 which is engageable with a lip portion 902 at an edge of the optical unit 900 so that the optical unit 900 is engaged to the groove portion 702 in a form-locking manner when the lip 902 and groove 702 portions are engaged. The upper apertures 726 permit the passage of air into and out of the chamber below the optical unit 900, to cool the light source 400.

The chassis unit 700 may further exhibit heat-sink characteristics to function as an inactive heat exchanger that cools the modular light bulb 100 by dissipating heat into the surrounding area. For this purpose, in the exemplary embodiment described herein, the chassis unit 700 comprises fins (not shown) having lower apertures 732 in between to allow heat generated by the (insert enclosed) driver unit 500 to dissipate to the surrounding area. Heat generated by the driver unit 500, in turn, may dissipate from the insert 510 through the insert apertures 516 and then through the lower apertures 732 to the surrounding area.

FIG. 7A-7D illustrates the base unit 800 of the modular light bulb 100 in different perspective views. The base unit 800 is an independent component which may be manufactured separately. A plurality of base units 800 are engageable with a light bulb socket and may be given as a standard bi-pin base. It will be readily apparent to one of ordinary skill in the art, however, that the principles of the present disclosure can be practiced using other base types, for example, indoor and outdoor T-series or Tubular bulbs that are Linear, Circular-shaped, U-shaped, and Similar light bulbs that use single pin, bi-pin, quad-pin or similar bases that use Light Emitting Diode (LED), Light Emitting Plasma (LEP), Light Emitting Filament (LEF) or similar technology light bulb bases that may operate under the principles of the present disclosure.

The base unit 800 comprises a first portion 802 and a second portion 804 electrically isolated from one another. The first portion 802 and the second portion 804 form electrical contact points 810 for use with a light bulb socket and may have a different electrical polarity (positive or negative) when the base unit 800 is engaged within a light bulb socket and receives electrical current therefrom.

A first base unit 800 is engaged to one end of the chassis unit 700 and a second base unit is engaged to the opposite end of the chassis unit 700. The first base unit 800 has a first portion 802 and a second portion 804, for electrical connection to contact points 810 and engagement with the socket. A second base unit 808 has driver connectors 812 and 814 connected to conductors 506 and 508 for connecting the driver unit 500 with the light source 400. In this case, the connectors 812 and 814 are electrically insulated from pins 818. Internally within the base unit 808, the conductors 506 and 508 are connected to the first and second connectors 812 and 814 for connection to the driver unit 500.

Figure 8A:
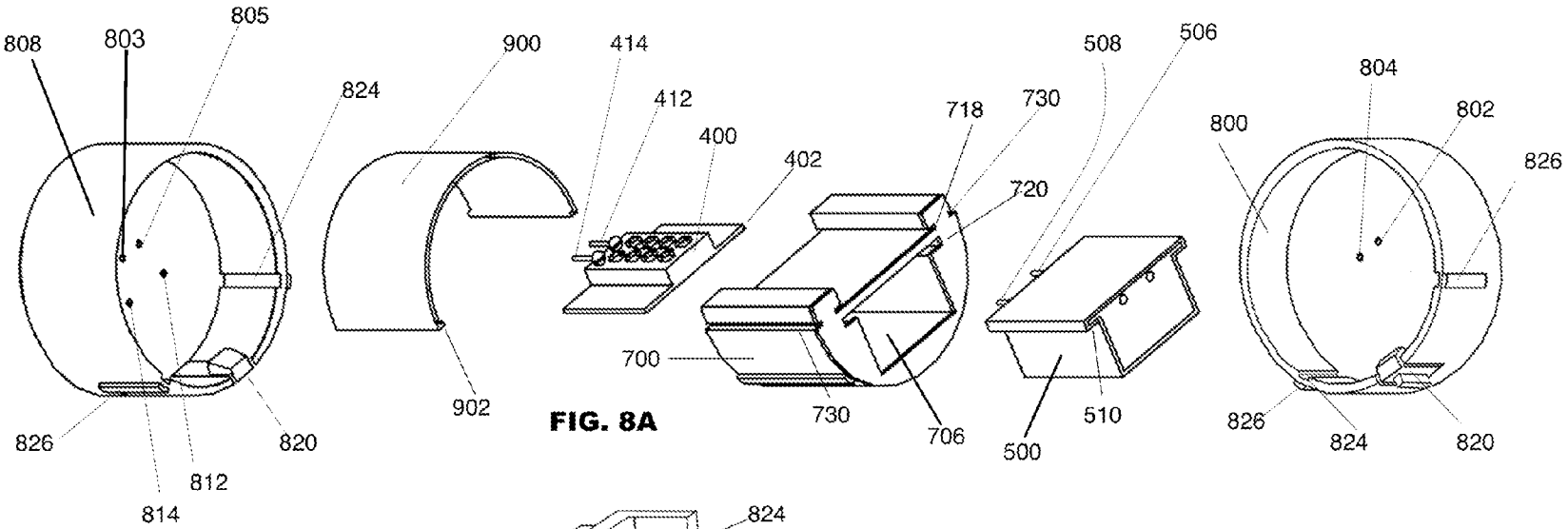
FIG. 8A illustrates the end assembly of the light bulb in an exploded, cut-away view.

FIG. 8A illustrates the assembly of the light bulb. The light source unit 400 is engaged onto the chassis 700, wherein the base 402 of the light source unit 400 has precise measurements to fit into a slot 718. The driver unit 500 may have precise measurements that fit into an inner structure of the insert 510 for holding the driver unit 500 in place. The insert 510, in turn, may have precise measurements that fit into the chassis unit 700, for example, using an edge to edge fit. For releasably fastening the optical unit 900 onto the chassis unit 700 in the exemplary embodiment described herein, the optical unit 900 comprises at its bottom a lip portion 902 which mates the groove portion 730 of the chassis unit 700 and is engageable therewith. For releasably fastening the base unit 800 onto the chassis unit 700 in the exemplary embodiment described herein, the base unit 800 comprises a groove 824 which mates the tab portion 724 of the chassis and is engageable therewith. The driver unit conductors 506 and 508 and the light source conductors 412 and 414 engage with each other through the base 808.

Figure 8B:
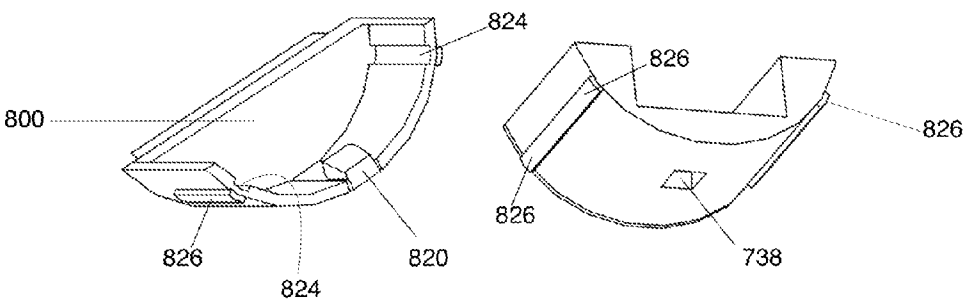
FIG. 8B illustrates the end assembly of the light bulb in a cut-away view.

Further, once the base unit 800 is engaged with the chassis unit 700 in this manner, a locking mechanism, such as in the exemplary embodiment described herein a snap fit lever hook mechanism, also known as a Cantilever Snap Joint mechanism, shown in detail in FIG. 8B, may be used to releasably lock the base unit 800 and the chassis unit 700 together. The second portion 804 of the base unit 800 therefore comprises a lever hook 820 which may slide into a corresponding mating hole 738 provided in the chassis unit 700. Once the lever hook 820 passes a latch edge provided at the chassis unit 700, the lever hook 820 deflects while passing the edge of the mating hole 738 and then returns to its original shape with the beam of the lever hook 820 tapered below the mating hole 738. Finally, the stress along the length of the lever hook 820 returns to its natural form to become evenly distributed, thus, locking the base unit 800 and the chassis unit 700 together.

Figure 9:
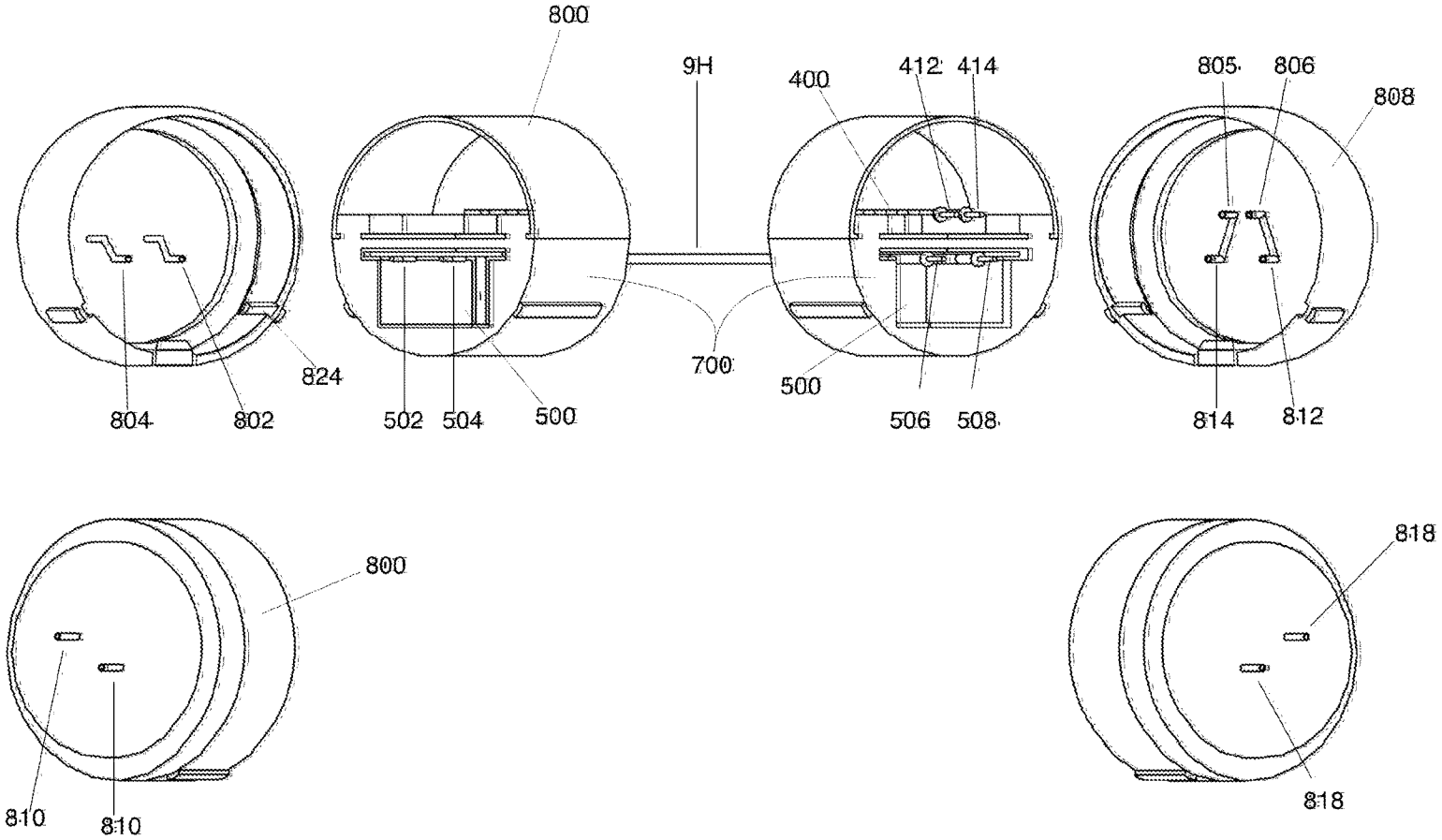
FIG. 9 illustrates the end assembly of the modular light bulb in an exploded view.

FIG. 9 illustrates the electrical connections between the base unit 800 and the driver unit 500 as well as between the driver unit 500 and the light source unit 400 of the modular light bulb 100 when the modular light bulb 100 is in an assembled state.

As may be seen in the left portion of FIG. 9, the conductors 506 and 508 which extend out of the chassis 700 from the (insert enclosed) driver unit 500 are received by the second portion 804 and first portion 802, respectively, of the base unit 800. A contact between the conductors 506 and 508 and the first and second portions 802 and 804 of the base unit 800 is thus created. When the base unit 800 is attached onto the chassis, as depicted in FIG. 9, the conductors 506 and 508 are engaged with the first and second portions 802 and 804 of the base unit 800. A contact between the conductor 508 and the first portion 802 of the base unit 800 and the conductor 506 and the second portion 804 are thus created and a releasable electrical connection between the base unit 800 and the driver unit 500 is therefore established.

As may be seen in FIG. 9, the light source unit 400 is fastened onto the chassis 700 by pushing the base 402 of the light source unit 400 into the slot 718 formed in the chassis 700 to form an interference fit therewith. The conductors 412 and 414 extending from the light source unit 400 are guided into socket holes 803 and 805 of the base 808. Further, the conductors 506 and 508 extending from the driver unit 500 are plugged into the connectors 812 and 814, respectively, in base 808. A releasable electrical connection between the light source unit 400 and the driver unit 500 is therefore established through base 808. Further, the conductors 502 and 504 extending from the driver unit 500 are plugged into the first portion 802 and second portion 804, respectively, in base 800.

It will be understood that the modular light bulb 100 described herein is merely exemplary and not limited to the above-describe specific characteristics. In particular, one skilled in the art will appreciate that the specific implementation of the fastening mechanisms described herein may be realized in various other forms.

It will be readily apparent to one of ordinary skill in the art that the principles of the present disclosure can be practiced using other releasable fastening techniques, such as, for example, an anchor bolt, batten, brass fastener, buckle, button, cable, captive fastener, clamp (or cramp), clasps, cleko, clips, clutch, drawing pin (thumbtack), flange, frog, grommet, hook-and-eye closure, hook and loop fastener, latch, nail, pegs, PEM nut, pins, retaining rings, rivet, rubber band (or bands of other materials), screw anchor, snap fastener, staple, stitches, strap, tie, toggle bolt, treasury tag, twist tie, wedge anchor, zipper, or other fastening techniques that may operate under the principles of the present disclosure.

Similarly, it is not obligatory to use a snap fit lever hook mechanism, also known as a Cantilever Snap Joint locking mechanism, to releasably lock the position of the optical unit relative to the chassis unit or to releasably lock the position of the base unit relative to the chassis unit. It will be readily apparent to one of ordinary skill in the art that the principles of the present disclosure can be practiced using other releasable locking techniques such as, for example, Spring latches, Threaded turn lock, Deadbolt latch, Slam latch, Cam lock, Norfolk latch, Snap latches, Suffolk latch, Crossbar, Cabin hook, Bolt lock latch, barrel bolt latches, Compression latch, Draw latch (both over- and under-center), Rotary latch or other locking techniques that may operate under the principles of the present disclosure.

Further, if the modular light bulb 100 is to be used as an outdoor light bulb, additional measures may be taken for water proofing the modular light bulb 100. For this purpose, one or more of the components of the modular light bulb 100 may be treated with a breathable silicon based substance that prevents water from affecting the respective components. The breathable silicon based substance may come in a liquid form which may be poured onto the electrical components and left to dry and harden. Once the substance dries and hardens, water does not affect electrical connections, thus, eliminating electrical shorts and corrosion. For example, the insert 510 may be treated with a breathable silicon based substance for such purposes. As another example for such measure, a waterproof seal may be provided in the region where the base unit 800 and the chassis 700 are fastened together in order to prevent water from entering in.

Figure 10:
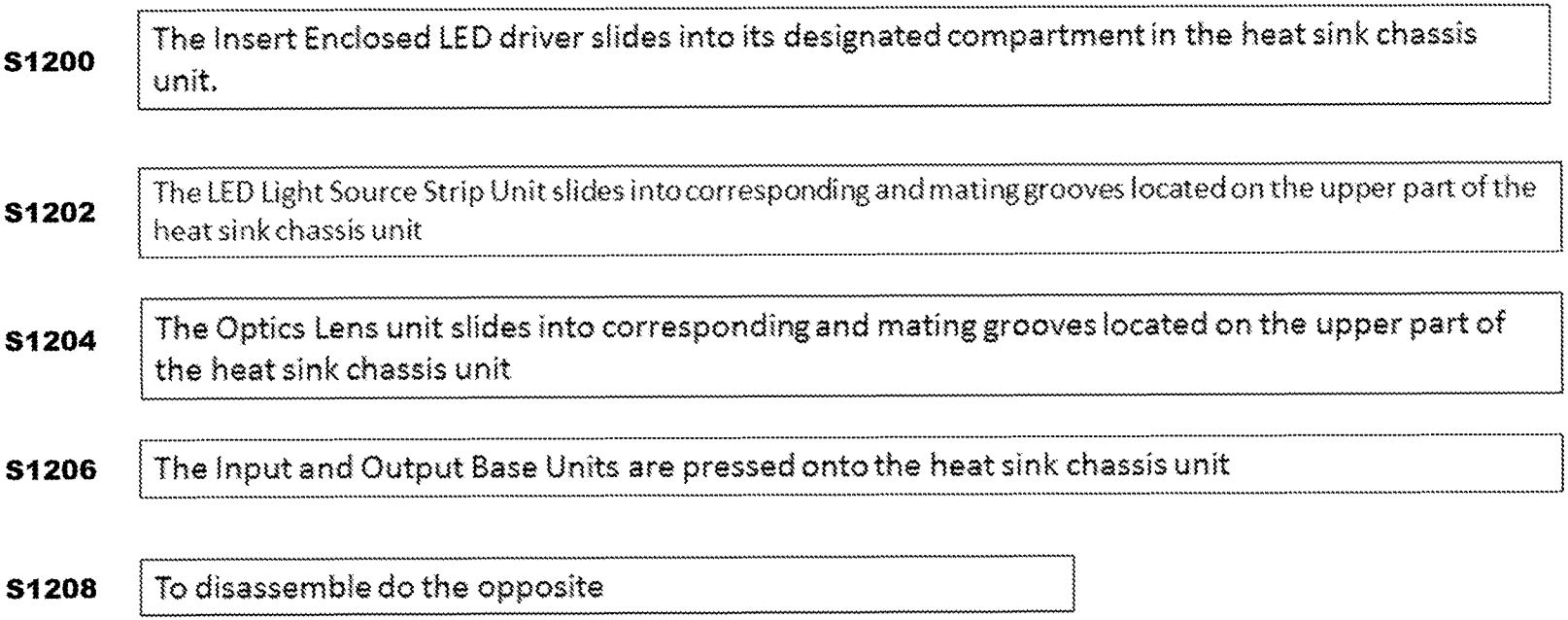
FIG. 10 schematically illustrates a flowchart of a method of assembling the modular light bulb.

FIG. 10 schematically illustrates a flowchart of a method of assembling the modular light bulb 100. In step S1200, the pre-assembled (insert enclosed) driver unit 500 is inserted into the chassis unit 700 to be accommodated within the chassis unit 700. In step S1202, the light source unit 400 is inserted into the chassis slot 718. In step S1204, the optical unit 900 has a lip portion 902 that is engageable with a groove portion 730 of the chassis unit 700. In step S1206 the base unit 800 is fastened onto one end of the chassis 700 and the base unit 808 is fastened to the other end of the chassis 700. To that end, the conductors 412 and 414 extending from the light source unit 400 are guided into socket holes 803 and 805 of the base 808. Further, the conductors 506 and 508 extending from the driver unit 500 are plugged into the connectors 812 and 814, respectively, in base 808. A releasable electrical connection between the light source unit 400 and the driver unit 500 is therefore established through base 808. Further, the conductors 502 and 504 extending from the driver unit 500 are plugged into the first portion and second portion 802 and 804, respectively, in base 800.

In step s1208, in order to disassemble the modular light bulb 100, corresponding unfastening steps may be performed. Disassembling the modular light bulb 100 may be required, for example, if one or more components of the bulb need replacement. A replacement requirement may be identified, for example, by observation including visual identification, scent and a process of elimination. For example, if the optical unit 900 breaks, a user may be able to visually identify that a replacement of the optical unit is required. As another example, if the driver unit 500 stops functioning, a user may be able to identify a darkened part or a smell indicating the presence of burned material. The chassis unit 700 and the base unit 800, on the other hand, can be expected to have a long life expectancy unless they are physically and accidentally damaged. Such defect may be identifiable by a user as well.

As has become apparent from the above description, due to the modularity of the modular light bulb, due to the releasability of the fastening techniques used to connect the respective components of the bulb together, and due to the releasability of the electrical connections formed between the respective components, the respective components of the modular light bulb according to the present disclosure may be assembled and disassembled in an adhesive-less, solderless and tool-less manner. As a consequence, the bulb does not need to be trashed entirely when it breaks. Components that are still in good working condition may be replaced or recycled. Manufacturing defects, defective material, accidental damages of the bulb or even bulb performance upgrades can be handled easily by simply replacing one or more respective components of the bulb.

The bulb is generally serviceable or upgradable by a layperson because no tools are required for assembly or disassembly. Factory assembly and the corresponding costs may thus be avoided. As to the assembly, four soldering points for electrically connecting the driver unit to the base unit and four soldering points for electrically connecting the driver unit to the light source unit typically used in prior art light bulbs are dispensable. Also, adhesive material or thermal bonding typically used in prior art light bulbs to fasten the optical unit onto the chassis unit and to fasten the base unit to the chassis unit of the bulb is not needed.

It is believed that the advantages of the modular light bulb presented herein will be fully understood from the foregoing description, and it will be apparent that various changes may be made in the form, constructions and arrangement of the exemplary aspects thereof without departing from the scope of the invention or without sacrificing all of its advantageous effects. Because the modular light bulb presented herein can be varied in many ways, it will be recognized that the invention should be limited only by the scope of the claims that follow.

I claim:

1. A modular light bulb comprising:

a light source unit;

an optical unit enclosing the light source unit;

a driver unit configured to drive the light source unit;

first and second base units engageable with a light bulb socket; and a chassis unit, wherein the driver unit is removably accommodated within the chassis unit and has a releasable electrical connection to the first base unit, wherein the light source unit has a releasable electrical connection to the first base unit, wherein the first and second base units are releasably fastened onto opposite ends of the chassis, wherein the light source unit is releasably fastened onto the chassis, and wherein the optical unit is releasably fastened onto the chassis unit.

2. The modular light bulb of claim 1, wherein the releasable electrical connection between the driver unit and the first base unit comprises at least one plug and socket connection.

3. The modular light bulb of claim 1, wherein the releasable electrical connection between the light source unit and the first base unit comprises a plug and socket connection formed between the light source unit.

4. The modular light bulb of claim 2, wherein a plug for the plug and socket connection is formed of two conductors extending from the light source unit.

5. The modular light bulb of claim 1, wherein the base unit comprises a first portion and a second portion electrically isolated from one another, wherein the releasable electrical connection between the driver unit and the base unit comprises a first conductor extending from the driver unit and contacting the first portion of the base unit and a second conductor extending from the driver unit and contacting the second portion of the base unit.

6. The modular light bulb of claim 5, wherein the first conductor is received in a retaining hole formed at the first portion of the first base unit.

7. The modular light bulb of claim 1, wherein the driver unit is enclosed in an insert fitting into the chassis unit.

8. The modular light bulb of claim 7, wherein the insert includes at least one aperture for heat dissipation.

9. The modular light bulb of claim 1, wherein the chassis unit comprises apertures for heat dissipation on its outside.

10. The modular light bulb of claim 1, wherein the optical unit is fastened to the chassis unit using a form-lock and wherein the chassis unit comprises at least one groove in a region of the form-lock so that the at least one groove forms an aperture for heat dissipation.

11. The modular light bulb of claim 1, wherein a releasable locking mechanism is used for releasably fastening the first and second base units onto the chassis unit, the light source unit onto the chassis unit, and the optical unit onto the chassis unit.

12. A method of assembling a modular light bulb, the method comprising:

inserting a driver unit into a chassis unit;

fastening a light source unit onto the chassis unit, the light source unit and the chassis unit being configured to be releasably fastened to one another, the driver unit being configured to drive the light source unit;

fastening an optical unit onto the chassis unit, the optical unit and the chassis unit being configured to be releasably fastened to one another, so that the optical unit encloses the light source unit; and fastening first and second base units onto opposite ends of the chassis unit, the base unit and the chassis unit being configured to be releasably fastened to one another, wherein fastening the first base unit onto the chassis unit comprises establishing a releasable electrical connection between the first base unit and the driver unit and establishing a releasable electrical connection between the first base unit and the light source unit, the first and second base units being engageable with a light bulb socket.

* * * * *